United States Patent [19]

Vance et al.

[11] Patent Number: 4,459,189

[45] Date of Patent: Jul. 10, 1984

[54] ELECTRODE COATED WITH LEAD OR A LEAD ALLOY AND METHOD OF USE

[76] Inventors: Christopher J. Vance, 46, Ch. de la Montagne, 1224 Chêne-Bourgeries; Thinh Nguyen, 20,Av. de Gros-Chene, 1213 Onex; Jean-Marie Fresnel, 2, Hameau du Petit Champ,, Thiory 01630 St. Genis, Switzerland; Henri B. Beer, Boswachtersdreef 36, 2180 Heide-Kalmthout, Belgium; Siegfried Ernst, 25, Rue de la Filature, 1227 Carouge, Switzerland

[21] Appl. No.: 467,088

[22] Filed: Feb. 16, 1983

[30] Foreign Application Priority Data

Feb. 18, 1982 [EP] European Pat. Off. ..... 82810075.0

[51] Int. Cl.[3] ..... C25C 1/12; C25B 11/00

[52] U.S. Cl. ..... 204/106; 204/108; 204/112; 204/114; 204/290 R; 204/290 F

[58] Field of Search ..... 204/290 F, 290 R, 106, 204/108, 112, 114

[56] References Cited

U.S. PATENT DOCUMENTS 4,373,654 2/1983 Perngaman ..... 204/286

4,380,493 4/1983 Wortley ..... 204/290 F

*Primary Examiner*—John F. Niebling

*Attorney, Agent, or Firm*—John J. Freer; Bruce E. Harang

[57] ABSTRACT

An electrode in particular an oxygen-evolving anode for metal electrowinning from an acid electrolyte comprises a body of aluminum or other metal coated with lead or a lead alloy by electroplating preferably from a non-aqueous electrolyte. The substrate can be a sheet of aluminium or compacted particles of aluminium plated with lead or a lead alloy. A sheet of lead or lead alloy is clad to the electroplated substrate and advantageously an electrocatalytic material such as surface-activated valve metal sponge is applied to the surface of the lead or lead alloy.

12 Claims, No Drawings

ELECTRODE COATED WITH LEAD OR A LEAD ALLOY AND METHOD OF USE

TECHNICAL FIELD

The invention relates to electrolysis electrodes which are coated with lead or a lead alloy, as well as to methods of manufacturing the electrodes. The electrodes are useful as anodes, cathodes and bipolar electrodes in various electrolysis processes, one advantageous use being as oxygen-evolving anode in metal electrowinning from an acid electrolyte.

BACKGROUND ART

At present, probably the best anode for oxygen-evolution is that described in U.K. patent specification No. 1.399.576, having a coating containing a mixed crystal of tantalum oxide and iridium oxide. However, known electrodes of this type contain at least about 7.5 g/m$^2$ of iridium so that despite their excellent performance in terms of over-voltage and lifetime, the high cost of iridium makes these electrode less attractive and in order to be competitive with cheaper anodes they must be operated at a relatively high anodic current density which necessitates various expedients in the cell design. Consequently, anodes made of solid lead, lead alloys, cobalt-silicon alloys and so forth are still used in many electrowinning plants despite the known disadvantages of such materials.

Massive anodes of lead and lead alloys such as lead-silver thus remain the most widely used anodes in metal electrowinning from sulphate electrolytes despite problems of weight, poor mechanical strength and high over-voltage. Lead-silver alloys offer a lower over-voltage and are less subject to corrosion in zinc electrowinning, but massive anodes of these alloys are very expensive.

French Pat. No. 2,399,490 has proposed an electrowinning anode consisting of tubes of aluminum coated with an extrusion drawn lead-silver alloy; this seeks to provide a lightweight and relatively inexpensive structure compared to conventional massive lead-silver anodes, but is subject to numerous drawbacks. Firstly, the extrusion drawing process is expensive, does not provide an excellent electrical contact and is limited to tubular and rod-like sections. Secondly, in electrowinning applications the rod-like configuration results in a voltage penalty of about 350 mV compared to massive anodes, as well as a greater dissolution of lead leading to increased contamination of the cathodically deposited metal, e.g. zinc.

DISCLOSURE OF INVENTION

A main aspect of the invention, as set out in the claims, is an electrolysis electrode comprising an electrically conductive body of aluminium, titanium, zirconium, niobium, molybdenum, tungsten, tantalum, magnesium alloys, iron, steel, nickel, copper or alloys of these metals or graphite, coated with an electroplated layer of lead or a lead alloy to which a sheet of lead or lead alloy is bonded. In many instances, aluminium will be very advantageous as the electrically conductive body or substrate, and the invention will be more particularly described by way of example with aluminium as the substrate material.

Thus, the invention more specifically provides an electrolysis electrode, primarily an improved oxygen-evolving anode, in the form of a light and mechanically strong structure comprising a body of aluminium coated with an electroplated layer of lead or a lead alloy to which a sheet of lead or lead alloy is bonded, which will advantageously replace the massive lead or lead alloy electrodes heretofore used in metal electrowinning, and is also useful in other processes, e.g. organic electrosynthesis, in which lead anodes have been used. Other uses, such as cathodes for some processes, or bipolar electrodes or battery electrodes are also envisaged.

The lead or lead alloy is preferably electroplated directly on the substrate material, e.g. aluminium, this advantageously being achieved by removing oxide skin from the aluminium and electroplating lead or a lead alloy directly onto the aluminium from a non-aqueous electrolyte based on an aluminium halide dissolved in an aromatic hydrocarbon. Alternatively, lead can be electroplated from an aqueous plating bath in which case, after removal of its oxide skin, the aluminium must be pre-plated with thin protectivr layers of, for example, zinc or tin covered with copper. Electroplating of lead from a molten salt electrolyte is another possibility. In these manners, but preferably by the direct, non-aqueous plating method, a well adherent and pore-free coating of lead or lead alloy can be built up to a desired thickness.

In one particular embodiment of the invention, the anode is composed of aluminium particles electroplated with a coating of lead or a lead alloy, preferably by non-aqueous electroplating, and then consolidated into a body by pressing the coated particles together; the body thus formed may be further coated with an additional electroplated layer of lead or a lead alloy, if desired, before bonding the outer sheet of lead or lead alloy. This embodiment has the advantage that when the anode is used in a corrosive environment and is liable to damage, as for example by short-circuiting due to dendrite formation of a cathodically deposited metal such as zinc, corrosion of the aluminium will be strictly localized to the damaged part. Thus, the composite anode body takes maximum advantage of the excellent corrosion resistance of lead while benefitting from the lightness and good conductivity of aluminium.

In a modification of this embodiment, alumium particles electrocoated with lead or a lead alloy can be coated onto an aluminium sheet with an electroplated lead or lead alloy layer; a further layer of lead or lead alloy can then be electroplated on top if desired, and finally a sheet of lead or lead alloy is bonded onto the composite.

Bonding a sheet of lead or lead alloy onto an electroplated lead or lead alloy underlayer on a sheet aluminium substrate, or a composite substrate comprising aluminium particles coated with lead, avoids long plating times for the production of a thick, protective lead or lead alloy coating and the bond can be achieved with a negligeable ohmic loss at the interface. Such a bonding of sheet lead directly onto aluminium and other valve metals is not feasible, and the pre-applied electroplated layer serves to provide an excellent bond using conventional cladding techniques employing heat and pressure, in particular rolling techniques. Conveniently, after rolling lead or lead alloy sheets onto either side of a lead plated aluminium sheet, protruding edges of the sheets are simply folded over and sealed by applying heat and pressure.

The operative surface of the electrode may be the sheet of bonded or clad lead, or it can be advantageous to use sheets of lead-silver, lead-calcium or lead-antimony alloy as the active surface to provide an anode which replaces massive lead-silver, lead-calcium or lead-antimony anodes but at a fraction of the cost and with improved mechanical strength and conductivity.

However, in many instances it will be advantageous to apply an electrocatalytic material to the surface of the bonded sheet of lead or lead alloy. The electrocatalytic material may consist for example of electroplated lead dioxide or manganese dioxide, or can be a coating formed by applying a solution of a compound which decomposes to form an electrocatalyst at a temperature preferably below about 325° C., and heating to decompose the compound. Alternatively, the electrocatalyst can consist of a powder which is pressed, hammered or rolled into the lead surface, or is applied in a binder. For example, pre-prepared powders of solid solutions of ruthenium-titanium dioxide, ruthenium-manganese dioxide or iridium-tantalum oxide can be used, or powders of ruthenium dioxides, manganese dioxides or magnetite, as well as mixtures of these powders.

A particularly preferred electrocatalytic material consists of surface-activated particulate valve metal, in particular a flattened sponge such as titanium sponge. The particulate valve metal is surface-activated with a suitable electrocatalytic material typically the platinum-group metals platinum, palladium, rhodium, iridium and ruthenium or their oxides possibly in combination with other oxides such as the oxides of tin, manganese, cobalt, chromium, antimony, molybdenum, iron, nickel, tungsten, vanadium, silicon, lanthanum, tellurium, phosphorus, boron, beryllium, sodium, lithium, calcium, strontium, lead and copper, these other oxides usually being present in minor or trace amounts. This surface activation of the valve metal particles can take place prior to or after applying the particles onto the lead surface of the composite anode; it may also be convenient to do a preliminary activation of the particles with a high-temperature bake (i.e. above 325° C.) and a final activation once the particles have been applied to the lead surface, followed by baking at a temperature below 325° C. Typically, these valve metal particles will have a size from about 75–850 micron, usually from 150–600 micron; however, after pressing, particles of sponge will be deformed into flattened shapes which may be bigger. Usually, the loading of particles will be from about 50–2000 g/m$^2$ of the anode surface area, 300–800 g/m$^2$ generally being adequate, the electrocatalyst (calculated as platinum-group metal) usually corresponding to 0.3–6% by weight of the valve metal of the particles. The particles can be applied by hammering, pressing, rolling or in any other convenient manner. The preparation and application of such surface-activated particles to a lead substrate is more fully described in European patent application No. 81. 810324.4 (published on Mar. 3, 1981 under No. 0046727), the contents of which are herein incorporated by way of reference.

The provision of a surface electrocatalyst is advantageous in that the lead or lead alloy remains electrochemically inactive and simply acts as a conductive and relatively corrosion-resistant support for the active electrocatalyst where the oxygen evolution reaction takes place. Consequently, corrosion of the lead or lead alloy, which would take place when the lead or lead alloy is used as the active electrode surface, is virtually eliminated and therefore relatively thin layers of lead can be used without fear of corrosion of the lead or lead alloy producing holes exposing the aluminium substrate.

The various described anodes are particularly advantageous when used for the electrowinning of metals such as zinc, copper, cobalt or nickel from a sulphate electrolyte. In zinc electrowinning with conventional massive lead or lead alloy electrodes, zinc dendrites grow on the cathode and may come to touch the anode, this causing short-circuits which melt lead or lead alloy at the surface and burn holes in the anode. However, with anodes according to the invention this problem is considerably diminished because of the excellent heat conductivity of the aluminium core. This is illustrated by the following simple test. Sheets of (a) lead, (b) zinc and (c) aluminium plated and clad with lead in accordance with the invention were exposed to a flame at approx. 1500° C., and the time for the surface to begin melting was measured. This was: (a) lead 9 seconds; (b) zinc 15 seconds; (c) aluminium/lead 30 seconds. These test data can be extrapolated to commercial zinc electrowinning practice as follows. When a zinc dendrite touches a lead electrode, the zinc dendrite conducts away heat better than the lead electrode, and the surface of the lead electrode overheats and is burnt. However, when a zinc dendrite touches an aluminium/lead electrode according to the invention, the aluminium core conducts heat away rapidly so that the lead surface does not overheat, whereas the zinc dendrite conducts away heat less well and will be preferentially burnt away.

This excellent resistance of the composite electrodes according to the invention to damage by short-circuiting is further enhanced when a suitable electrocatalyst is provided on the lead or lead alloy surface, in particular a surface-activated particulate valve metal, the best protection effect being obtained with flattened surface-activated valve metal sponge.

By suitably choosing the lead electroplating/cladding conditions as well as preferably including a surface electrocatalyst, it is possible to virtually eliminate any risk of damage to the lead coating which would be followed by corrosion of the aluminium substrate. However, if corrosion of the aluminium does take place, this is by no means a serious problem in metal electrowinning since the aluminium does not take plate out with and contaminate the cathodically deposite metal, but either precipitates out or remains in solution. To avoid any problems of contamination of the cathodically deposited metal or of reduction of the current efficiency, the aluminium will either be essentially pure or may be alloyed with metals which are harmless in the electrowinning environment, for example magnesium, silicon or in some instances copper (e.g. in copper electrowinning). To the contrary, it should not contain any appreciable amount of metals which are poisons in the environment such as tin, antimony, cobalt or copper for zinc electrowinning. Similar considerations apply to the alloying elements for the lead alloys. The most usual alloys will be lead-silver for zinc electrowinning, and lead-calcium and lead-antimony for copper electrowinning.

The aluminium substrate will usually be in the form of a solid sheet, this being particularly advantageous for metal electrowinning applications, but it is also possible to use sheets of an expanded aluminium mesh or grid which are coated e.g. by the non-aqueous plating method and then bonded to a lead sheet and possibly coated with a catalyst. As previously mentioned, aluminium powder coated with lead can also be used as the substrate to which the lead or lead alloy sheet is bonded.

For some processes, for example for the synthesis of adiponitrile, it is possible to incorporate the lead-coated and clad aluminium anode into a bipolar electrode. For instance, an aluminium substrate could be electroplated and cladded with lead or a lead alloy (e.g. lead-silver) on its anode side, and optionally carry an electrocatalyst such as magnetite mixed with platinum, or a mixed ruthenium-titanium oxide, or silver. The cathode side would carry a suitable cathodic material, e.g. it could be plated/clad with lead or cadmium. Such bipolar electrodes are also useful for water electrolysis to produce hydrogen and oxygen from a sulphuric acid based electrolyte; in this instance, the cathode face can incorporate any suitable hydrogen evolution catalyst, a layer of nickel-aluminium-molybdenum (from which the aluminium is leached) being one possibility. In some processes, the substrate material, e.g. iron, steel or nickel could operate as the cathodic surface of the bipolar electrode.

In the other applications, the lead-coated and clad side could act as cathode of a bipolar electrode with an appropriate anodic material as the other side of the substrate.

Although the invention has been described mainly with reference to an aluminium substrate, as a modification it is possible to use a substrate of titanium, zirconium, niobium, molybdenum, tungsten, tantalum, magnesium alloy, iron, steel, nickel, copper or alloys or these metals or graphite. The substrates titanium through magnesium alloys may advantageously be incorporated in bipolar electrodes. Nickel and copper substrates can be advantageous respectively for nickel and copper electrowinning anodes.

ELECTROPLATING METHOD

Manufacture of the composite anodes preferably includes the step of electro-coating onto the aluminium or other substrate from a non-aqueous electrolyte. This is advantageously carried out by a novel method in which etching of the aluminium or another valve metal substrate and subsequent electroplating with lead or lead alloy is carried out in a single bath of suitable composition, instead of the conventional process in which the aluminium or other substrate is etched in a first bath and then transferred to a separate plating bath.

In effect, an oxide-free surface of aluminium can be obtained by etching in a solution of an aluminium halide ($AlX_3$) and an aromatic hydrocarbon (ah), the $Al_2O_3$ film being dissolved in this medium by formation of soluble oxy-halide complexes with $AlX_3$. This etching step can be accelerated by anodization of the aluminium substrate. A very clean surface of aluminium can be obtained rapidly by this method if the $AlX_3$-ah solution contains a certain quantity of alkali and/or metallic halides. The presence of a minimum quantity of alkali and/or metallic halides is necessary to dissolve the $AlX_3$ formed by anodiation of the Al substrate, by the formation of $[M^{n+}.nAlX_4-]$ or $[M^{n+}.nAl_2X_7-]$ complexes which are more soluble than $AlX_3$ in ah.

By using an appropriate metallic halide $MX_n$ as the complexing agent in solution, the electrodeposition of M can be obtained directly onto the aluminium substrate by a subsequent cathodic polarization in the same solution. The surface treatment of the aluminium substrate is preferably carried out with an acidic composition of the bath, because the dissolution of the aluminium oxide film is only possible in the presence of $Al_2X_6$ or $Al_2X_7$- forms. Consequently, this process applies mainly to metals which are deposited at a potential more positive than aluminium and, because of the potential levelling effect of $AlX_3$-ah medium, an alloy deposit can be obtained by using a mixture of metallic halides. In particular the process applies to the electrodeposition of lead and alloys such as Pb-Ag, Pb-Ca, Pb-Sb.

A very adherent Pb deposit may be obtained directly onto an Al substrate from a solution of $AlCl_3$-$PbCl_2$-LiCl in toluene. $AlCl_3$ is preferable to $AlBr_3$ or $AlI_3$ because of its stronger affinity to form the oxyhalide complexes. $AlF_3$ is not soluble in ah. Toluene is the preferred ah solvent because its basicity is weak enough not to decrease the etching power of $AlCl_3$. Benzene can also be used but the solubility of $AlCl_3$ in toluene is higher than in benzene, and the latter is more toxic.

The bath conductivity increases with the concentration of $AlCl_3$, and the $AlCl_3$: toluene molar ratio is preferably between 0.20 and 0.40, the optimum $AlCl_3$: toluene molar ratio being 0.33. The concentration of $PbCl_2$ and LiCl depends on the total quantity of $AlCl_3$ in solution. The total molar ratio $[PbCl_2+LiCl]:AlCl_3$ should be lower than 0.40 and higher than 0.20. The $LiCl:AlCl_3$ molar ratio is preferably between 0 and 0.30; the bath conductivity increases with the concentration of LiCl and the preferred $LiCl:AlCl_3$ molar ratio is therefore near the maximum value 0.30. With this maximum concentration of LiCl, the $PbCl_2:AlCl_3$ molar ratio should be lower than 0.10 and higher than 0.05. The concentration of chloride compounds of an optional alloying element (Ag, Ca) is generally fixed at about 1 mole % of that of $PbCl_2$. Excellent results have been obtained in the above indicated concentration ranges which are given for guidance and are not intended to define operating limits.

The process is conducted in an inert atmosphere such as nitrogen with an allowable $O_2$ and $H_2O$ content of about 0.5%.

The bath temperature is maintained at 25° to 65° C. The solubility of solutes increases with the temperature, but an operating temperature range of 35° to 45° C. is preferred to avoid solvent loss by evaporation.

The aluminium substrate is cleaned first by sandblasting or by alkali etching in order to remove the major part of the natural oxide film, and afterwards degreased in hot acetone, possibly with ultrasound. Pure aluminium or commercial alloys ("Anticorrodal") can be used as substrate.

The aluminium substrate is introduced into a bath with for example two Pb counter electrodes. The anodization step is made at a current density of 3 to 10 $mA/cm^2$. After the anodization step, the substrate is allowed to stand in solution during 2 to 5 minutes, with strong stirring in order to completely remove the traces of aluminum compounds formed by anodization. Afterwards, the substrate is polarized cathodically with a plating current density of 5 to 50 $mA/cm^2$. The optimum plating current density is 20 to 25 $mA/cm^2$. Adherent, impermeable Pb deposits, with a thickness of 50 to 150 micron, are obtained with a current efficiency of 75 to 100%.

Similar conditions are used for coating aluminium particles, but in this case the sandblasting step is replaced by an etching in NaOH 5% at 60° C.

Broadly, the novel electroplating method applies to the other mentioned substrates and in particular those with film-forming properties. Metals other than lead and various alloys can be electroplated. This method is claimed in copending application Ser. No. 467,153, Nguyen et al, and applies to the electroplating of metals such as lead, silver, copper, calcium, antimony, tin, cadmium, nickel and zinc and alloys of these metals onto a substrate of a film-forming metal from the group of aluminium, titanium, zirconium, niobium, molybdenum, tungsten, tantalum and alloys thereof, and consists of placing the substrate in an etching/electroplating solution comprising ions of the metal(s) to be plated (and optionally alkali metal ions), aluminium halide and an aromatic hydrocarbon; removing surface oxide from the film-forming metal substrate by reaction with the aluminium halide and the metal(s) in solution to form soluble complexes; followed by cathodically connecting the substrate and passing electrolysis current to electroplate the metal(s) onto the oxide-free surface. Removal of the surface oxide film is preferably assisted by anodising the substrate.

The invention will be further illustrated in the following Examples.

EXAMPLE 1

A solution of $PbCl_2$:$AlCl_3$:toluene (molar ratio 0.066:0.33:1.0) is prepared from commercial products (Fluka, puriss quality). A pure Al (99.9%) substrate of dimensions 2.5×6.5×0.1 cm was cleaned by sandblasting, and degreased in hot acetone with ultrasound during 10 minutes. Electrolysis was then carried out in a cylindrical glass cell, with magnetic stirring. The cell was placed in a glove box with a nitrogen atmosphere. Two Pb counter electrodes were used, the inter-electrode distance being 2.0 cm, and the toal immersed surface of the Al substrate 25 $cm^2$. The bath temperature was maintained at 40°–50° C.

The Al substrate was first polarized anodically at 10 $mA/cm^2$, the cell voltage being 6–7 volts. After passage of 200 Amp-seconds (8 Amp-sec/$cm^2$), the substrate was allowed to stand in the solution during 15 minutes. The deposition step was then made at 25 $mA/cm^2$, with a cell voltage of 8–9 volts. After passage of 2000 Amp-sec. (80 Amp-sec/$cm^2$), 1.82 g of Pb deposit was obtained. The average deposit thickness was 55–60 micron. The current efficiency was 85%.

The purity and impermeability of the Pb deposit were demonstrated by submitting the Pb coated Al electrode to voltammetry in HCl 5% at 20° C., and comparison with a pure Pb electrode. The adherence of the deposit was tested by bending the sample to more than 90°, the Al substrate breaking without peeling of the Pb layer.

EXAMPLE 2

A quantity of solid AgCl corresponding to 1 mole % of $PbCl_2$ was added to the preceding electrolyte. The electrolysis was made in the same conditions as Example 1 and a Pb-Ag alloy deposit was obtained.

The same electrolysis was then repeated, but with the AgCl additive replaced by $CaCl_2$.A Pb-Ca alloy deposit was obtained.

The following deposit compositions were obtained by X-ray diffraction analysis:

| Alloying element | Deposit surface composition |
|---|---|
| AgCl | Ag 1% - $PbO_2$ (<<1%) - Pb balance |
| $CaCl_2$ | Ca 1% - CaO (1%) - Pb balance |

The oxygen evolution potential of the Pb-Ag/Al electrode in sulphuric acid zinc electrowinning solution is 1.255 V vs. Hg/$HgSO_4$ at a current density of 400 $A/m^2$. This value is comparable with that of a bulk electrode of Pb—0.5% Ag.

EXAMPLE 3

A solution of $PbCl_2$:LiCl:$AlCl_3$:toluene (molar ratio 0.033:0.10:0.33:1.0) was prepared as above.

A commercial Al alloy substrate ("Anticorrodal") of dimensions 14.0×40.0×0.4 cm was cleaned and degreased as above. The electrolysis was conducted in a rectangular polypropylene cell with two Pb counter electrodes. Electrolyte circulation was insured by pumping at a rate of about 12 l/min. Anodization was carried out at 4 $mA/cm^2$ with a charge of 10 Amp-sec/$cm^2$. After a 15 minute rest period, a Pb deposit of 70 micron was obtained with a charge of 100 Amp-sec/$cm^2$ at 15 $mA/cm^2$.

Two Pb foils 1 mm thick were then clad onto the two Pb precoated sides of the Al substrate. The bonding can be achieved by rolling under usual conditions, for example at 150°–170° C. under a pressure of 250–500 $Kg/cm^2$, after first removing the lead oxide skin from the lead surfaces using an etching agent such as concentrated acetic acid. The deformation of the Pb foils is up to about 20%; no deformation of the substrate was observed.

The apparent density of this composite Pb-Al-Pb (1 mm-4 mm-1 mm) structure is 5.6 $g/cm^3$, compared to 11.39 $g/cm^3$ for lead and 2.7 $g/cm^3$ for "Anticorrodal" aluminium. Its electrical resistivity was $6.7\times10^{-6}$ ohm cm in the length direction, and $10.3\times10^{-6}$ ohm cm in the thickness direction, compared to $22.8\times10^{-6}$ ohm cm for lead and $5.1\times10^{-6}$ ohm cm for "Anticorrodal" aluminium. These measurements demonstrate that there is no contact resistance between the lead and aluminium.

A charge of 0.05 $g/cm^2$ of activated Ti particles of −28 mesh (<600 micron) was pressed onto the surfaces of the composite Pb-Al-Pb structure. A good penetration of the Ti particles onto the Pb layers was obtainbed at 500 $kg/cm^2$ at ambient temperature. The deformation of the Pb layers due to this pressing step was less than 10%.

EXAMPLE 4

Titanium sponge with a particle size of 315–630 micron and activated with a ruthenium-manganese dioxide coating was pressed onto the two faces of a composite electroplated/clad Pb-Al-Pb structure prepared as in Example 3. The application pressure was 440 $kg/cm^2$ and the sponge loading was 380 $g/m^2$.

The activated composite anode was then tested in a zinc electrowinning solution containing 170 g/l $H_2SO_4$, 50 g/l Zn, 4 g/l Mn and the usual trace elements. At a current density of 400 $A/m^2$ the composite anode had an oxygen evolution potential of 1520 mV (vs. NHE) compared to 2100 mV for a bulk lead anode and 1950 mV for a bulk Pg/Ag 0.75% anode. After 3 days continuous operation, the composite anode displayed no sign of corrosion of the lead or the aluminium substrate, and was operating at a steady potential of 1730 mV (which is excellent in this solution).

EXAMPLE 5

A charge of 33 g of Al particles (99% purity) of dimensions 1 mm diameter and 20–30 mm length was etched in NaOH 5% at 60° C. for 5 minutes, rinsed first in water, then with acetone and dried in a nitrogen flow. The particles were then placed in a glass cell containing the same electrolyte as in Example 3. A titanium disc placed at the bottom of the cell served as the cathodic current feeder. A lead counter electrode was placed horizontally at a distance of 3 cm from the Al particle mass. The particles were agitated by a magnetic stirrer.

After an anodisation step at 0.3 Amp (9 Amp/kg particles) with a charge of 540 Amp-sec ($16\times10^3$ Amp-sec/kg particles), the Al particles were allowed to stand in the electrolyte for 15 minutes, with agitation. The subsequent lead deposition step was carried out at 1.5 Amp (45 Amp/kg particles) with a charge of $22\times10^3$ Amp-sec ($61\times10^4$ Amp-sec/kg particles); 26.25 g of Pb deposit was obtained on the surface of the Al particles. The apparent current efficiency was about 112%, and can be explained by the cementation of lead onto the active surfaces of the Al particles during the rest period.

The average thickness of the lead deposit, examined under microscope, was about 40–50 micron; the maximum thickness was about 100 micron and the minimum value was 20 micron.

The Pb coated Al particles were etched in 1 M acetic acid solution, washed with water, rinsed with acetone and dried in nitrogen flow.

A charge of 12 g of the Pb coated Al particles was pressed in a mould of 2.5 cm diameter at 250 kg/cm$^2$ and 170° C. A rigid structure of 2.5 cm diameter and 0.8 cm thickness was obtained. The apparent density was 3.04 g/cm$^3$. The apparent porosity was estimated at about 10%, the pores being confined to the surface layer. Inside the structure, the Pb-Pb bonding was very good and the compactness was practically 100%. The electrical resistivity in the thickness direction was $6.7\times10^{-6}$ ohm cm.

A charge of 12 g of the Pb coated Al particles was pressed between two Pb discs of 1 mm thickness under the same conditions as above. A rigid structure of 2.5 cm diameter and 1.0 cm thickness was obtained. The apparent density was 4.83 g/cm$^3$, and the apparent porosity was estimated at about 7%. The electrical resistivity in the thickness direction was $15\times10^{-6}$ ohm cm.

The corrosion resistance of the pressed structure of Pb coated Al particles was tested in $H_2SO_4$ solution (150 g/l), at an anodic current density of 400 A/m$^2$. After one week, the weight loss was less than 3 mg/cm$^2$ or less than 3 micron/day. A decrease of the corrosion rate with time was observed.

The self protecting character of the Pb-coated Al particle electrodes was demonstrated by the corrosion test of a structure having a pin hole made by a drill of 2 mm diameter. After one week, under the same test conditions as above, the dissolution of Al was only observed for 6 particles which were initially damaged.

EXAMPLE 6

A solution of $PbCl_2$:LiCl:$AlCl_3$:p-xylene (molar ratio 0.0165:0.20:0.33:1.00) was prepared.

A commercial Ti substrate of dimensions $2.5\times6.5\times0.1$ cm was cleaned and degreased as in Example 1. The electrolysis was conducted under similar conditions to Example 1. The anodisation step was carried out at 2 mA/cm$^2$; after a few minutes the electrolyte became dark brown due to the presence of the dissolved Ti species in solution. The subsequent deposition step was carried out immediately after the anodisation step, without any rest period. The initial current density was 2.5 mA/cm$^2$, and after 10 minutes was increased to 15 mA/cm$^2$. After passage of 625 Amp-sec (25 Amp-sec/cm$^2$), a smooth Pb deposit of about 20 micron was obtained. The adherence of the deposit was tested, with success, by bending tests.

We claim:

1. An electrolysis electrode comprising an electrically conductive body of a material from the group consisting of aluminium, titanium, zirconium, niobium, molybdenum, tungsten, tantalum, magnesium alloys, iron, steel, nickel, copper, alloys of these metals and graphite, coated with an electroplated layer of lead or lead alloy to which a sheet of lead or lead alloy is bonded.

2. The electrode of claim 1, wherein the electroplated layer of lead or lead alloy is directly plated on the conductive body.

3. The electrode of claim 1 or 2, wherein the electroplated layer and/or the bonded sheet consist of a lead-silver, lead-antimony or lead-calcium alloy.

4. The electrode of claim 1 or 2, wherein the conductive body consists of a sheet of aluminium.

5. The electrode of claim 1 or 2, wherein the conductive body consists of consolidated particles of aluminium coated with an electroplated layer of lead or a lead alloy.

6. The electrode of claim 1 or 2, wherein an electrocatalytic material is applied to the surface of the bonded lead or lead alloy sheet.

7. The electrode of claim 6, wherein the electrocatalytic material consists of a surface-activated particulate valve metal.

8. The electrode of claim 7, wherein the particulate valve metal is flattened sponge.

9. The electrode of claim 1 or 2, which is a bipolar electrode.

10. The bipolar electrode of claim 9, wherein the lead or lead alloy sheet bonded onto the electroplated lead or lead alloy layer forms the anode side, and the conductive body forms the cathode side or is coated with a cathodic material.

11. A method of electrowinning metals from a sulphuric acid containing electrolyte using as anode the electrode of any one of claims 1 or 2.

12. The method of claim 11, wherein the electrowon metal is zinc, copper, cobalt or nickel.

* * * * *